United States Patent [19]

Pulichino, Jr. et al.

[11] Patent Number: 5,060,767

[45] Date of Patent: Oct. 29, 1991

[54] SOFT LUGGAGE WITH OUTSIDE POCKETS

[75] Inventors: John V. Pulichino, Jr., Providence, R.I.; Joy Tong, New York, N.Y.

[73] Assignee: American Tourister, Inc., Warren, R.I.

[21] Appl. No.: 475,450

[22] Filed: Feb. 6, 1990

[51] Int. Cl.[5] ..... A45C 5/06

[52] U.S. Cl. ..... 190/111; 190/109; 190/903; 150/117

[58] Field of Search ..... 190/109, 111, 112, 100, 190/107, 110, 113, 903; 150/112, 117; 383/120; D3/48, 71, 76, 78

[56] References Cited

U.S. PATENT DOCUMENTS

| | | | |
|---|---|---|---|
| D. 257,906 | 1/1981 | Weinreb | D3/71 X |
| D. 268,305 | 3/1983 | Stark | D3/76 X |
| D. 268,627 | 4/1983 | Stark | D3/71 |
| D. 281,645 | 12/1985 | Bomes et al. | D3/71 X |
| 1,907,676 | 5/1933 | Roth | 190/119 |
| 2,177,624 | 10/1939 | Marks | 190/111 |
| 3,759,356 | 9/1973 | Bostick et al. | 190/111 |
| 4,573,202 | 2/1986 | Lee | 190/125 X |
| 4,588,056 | 5/1986 | Bernbaum | 190/107 |
| 4,729,460 | 3/1988 | Kim | 190/111 X |
| 4,895,230 | 1/1990 | King | 190/107 |

FOREIGN PATENT DOCUMENTS

| | | | |
|---|---|---|---|
| 2506780 | 2/1976 | Fed. Rep. of Germany | 190/111 |
| 401496 | 11/1933 | United Kingdom | 190/111 |

*Primary Examiner*—Sue A. Weaver

*Attorney, Agent, or Firm*—Wood, Herron & Evans

[57] ABSTRACT

Soft luggage has a fabric side wall. Two pockets are stitched to the side wall. Each pocket has a crescent-shaped upper edge and a crescent-shaped lid hinged to the side wall. A slide fastener connects the lid to the crescent-shaped upper edge to close the pocket.

2 Claims, 1 Drawing Sheet

SOFT LUGGAGE WITH OUTSIDE POCKETS

BACKGROUND OF THE INVENTION

This invention relates to soft luggage, and more particularly to pockets that are mounted on soft luggage and accessible from outside the luggage.

In soft luggage having conventional outside pockets, the access to the pocket is through an opening having a slide fastener that zips straight across the side wall of the luggage. Access to the pocket requires pulling the fabric away from the side wall. To put articles into the pocket, the fabric is pulled away and the articles are stuffed past the opening. To take articles out, the fabric is pulled away from the side wall and the operator's hand is forced past the slide fastener to drag the articles out past the slide fastener.

BRIEF SUMMARY OF THE INVENTION

An objective of the present invention has been to improve the access to the outside pockets of soft luggage.

The objective of the invention is attained by forming a pocket by stitching fabric to the side wall of the luggage in a U-shaped pattern. The transverse dimension of the fabric, at its opening, is substantially greater than the transverse dimension of the U-shaped stitching. Hence, the fabric bulges away from the side wall of the luggage and presents a crescent-shaped upper edge lid having a crescent-shaped free edge is hinged by stitching to the side wall of the luggage. It has a crescent-shaped free edge that aligns with the crescent-shaped upper edge of the pocket. A slide fastener joins the lid-free edge to the pocket upper edge.

The advantage of the pocket structure as described above is that it is very easy to open, and when open, presents a large area through which access may be had to the interior of the pocket.

BRIEF DESCRIPTION OF THE DRAWINGS

The object and features of the invention will become more readily apparent from the following detailed description taken in conjunction with the accompanying drawings in which.

DETAILED DESCRIPTION OF THE INVENTION

Figure 1:
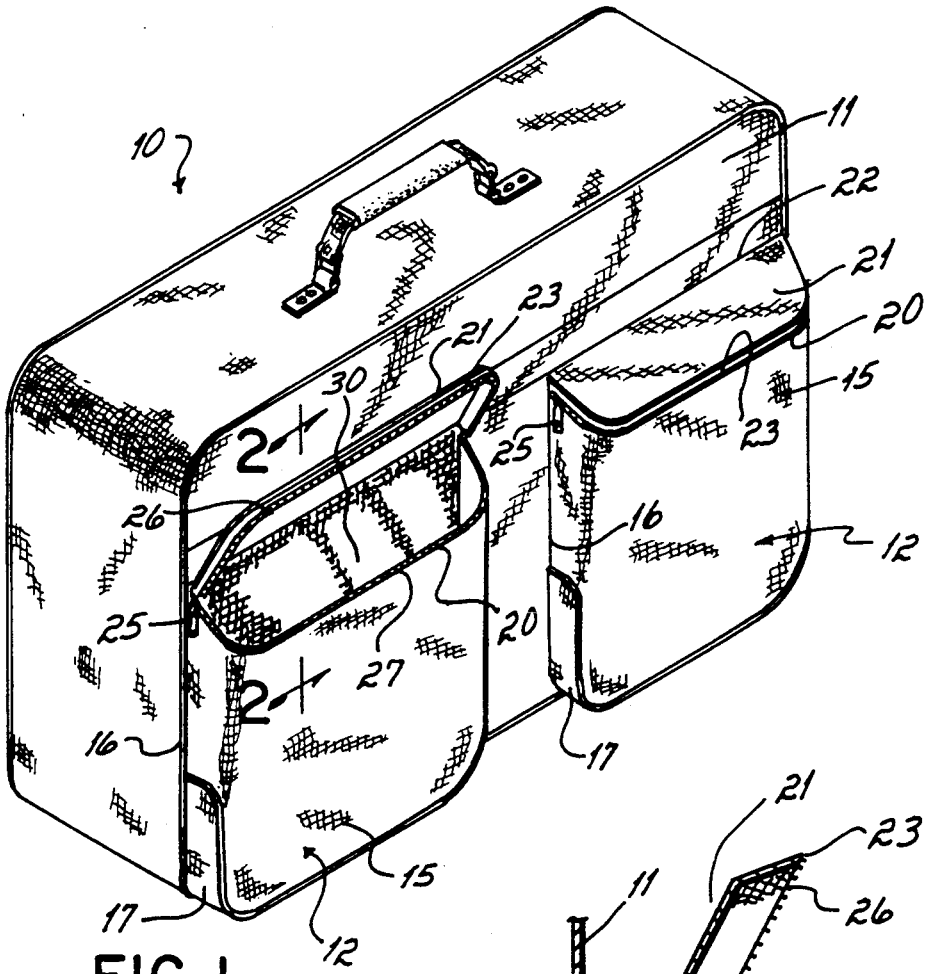
FIG. 1 is a perspective view of the luggage having the invention applied thereto.

As shown in FIG. 1, soft luggage 10 has a conventional side wall 11. The side wall has two identical pockets 12 mounted on it and projecting from it. Each pocket is formed by a pocket fabric 15 attached to the side wall 11 by stitching in a U-shaped pattern as at 16 to the side wall. The bottom of the pocket and a portion of the lower side portion of each pocket is formed by a gusset 17. The transverse dimension of the pocket fabric 15, when lying in a plane parallel to the bottom wall, is substantially greater than the transverse dimension of the U-shaped stitching 16, thereby creating an outwardly-bulging pocket that has a crescent-shaped upper edge 20.

Each pocket has a lid 21 which is stitched along one edge 22 to the side wall 11, thereby hinging the lid to the side wall. Each lid has a crescent-shaped free edge 23 which is aligned with the crescent-shaped upper edge 20 of the pocket. A slide fastener 25, including an upper track 26 and a lower track 27, is mounted on the free edge 23 and upper edge 20 to open and close the pocket.

Figure 2:
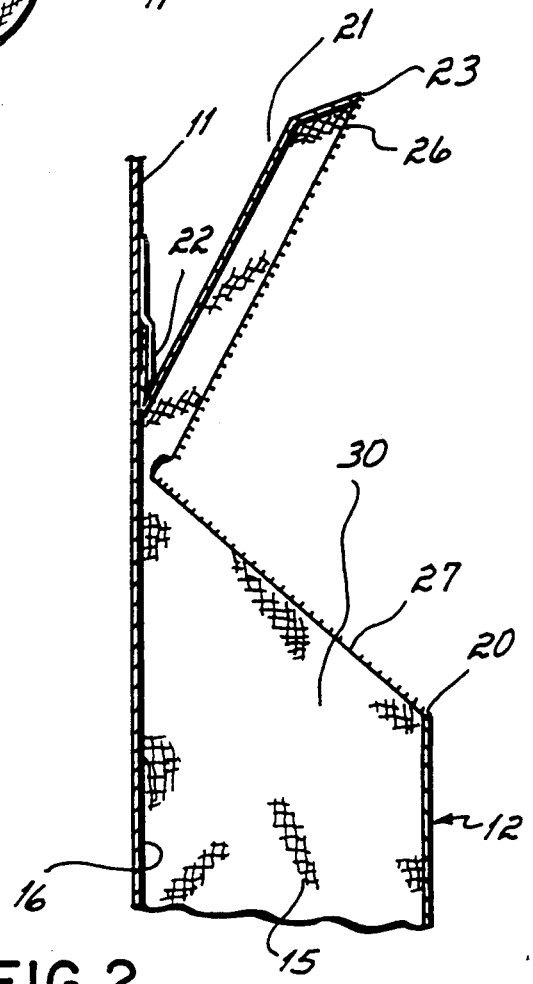
FIG. 2 is a cross-sectional view taken along lines 2—2 of FIG. 1.

As can easily be seen from FIGS. 1 and 2, when the lid is unzipped from the pocket and raised, a very large access opening 30 is presented for reaching into the pocket and for the ease of depositing articles in the pocket as well as withdrawing such articles.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A soft-sided suitcase comprising:

a container having a fabric side wall lying in a plane, a formed by pocket fabric pocket wall having a U-shaped edge stitched to said side wall to define a pocket, the transverse dimension of said pocket fabric being substantially greater than the transverse dimension of said U-shaped stitching, thus causing said pocket to bulge outwardly from said container side wall and present a crescent-shaped upper edge defining a wide opening, said pocket having a bottom wall and side walls, said fabric pocket wall including a gusset extending around the bottom and lower portion of the sides of said pocket to form said bottom and side walls to cause the pocket to bulge and create a substantial volume in an unfilled pocket between said pocket wall and said side wall, a lid having one edge stitched to said side wall adjacent said pocket opening, said lid projecting outwardly from said side wall and having a crescent-shaped free edge normally lying adjacent said pocket upper edge, and a slide fastener mounted on said adjacent edges to close said pocket, whereby when said lid is unzipped and said pocket is opening, said lid may be raised along the stitched edge to provide easy access to said pocket and contents contained therein through the wide opening of said pocket.

2. A suitcase as in claim 1 in which two identical pockets as defined in claim 1 are mounted side-by-side on said side wall.

* * * * *

UNITED STATES PATENT AND TRADEMARK OFFICE

CERTIFICATE OF CORRECTION

PATENT NO. : 5,060,767

DATED : October 29, 1991

INVENTOR(S) : John V. Pulichino, Jr. and Joy Tong

It is certified that error appears in the above-identified patent and that said Letters Patent is hereby corrected as shown below:

Column 1, line 29, after "edge" insert --.--

Column 1, line 29, before "lid" insert --A--

Column 2, line 28, after "a" delete "formed by pocket fabric"

Column 2, line 28, after "wall," insert -- formed by pocket fabric -- .

Signed and Sealed this

Thirtieth Day of March, 1993

*Attest:*

STEPHEN G. KUNIN

*Attesting Officer*

*Acting Commissioner of Patents and Trademarks*